US011065888B2

(12) United States Patent
Shimoni et al.

(10) Patent No.: US 11,065,888 B2
(45) Date of Patent: Jul. 20, 2021

(54) DYE SUBLIMATION CALENDER

(71) Applicant: Kornit Digital Ltd., Rosh HaAyin (IL)

(72) Inventors: Allon Shimoni, Modiin-Maccabim-Reut (IL); Alon Feldman, Kibbutz Kfar-Menachem (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 16/474,076

(22) PCT Filed: Dec. 28, 2017

(86) PCT No.: PCT/IL2017/051401

§ 371 (c)(1),
(2) Date: Jun. 27, 2019

(87) PCT Pub. No.: WO2018/122854

PCT Pub. Date: Jul. 5, 2018

(65) Prior Publication Data

US 2020/0122485 A1 Apr. 23, 2020

Related U.S. Application Data

(60) Provisional application No. 62/439,506, filed on Dec. 28, 2016.

(51) Int. Cl.
*B41J 3/407* (2006.01)
*B41J 11/00* (2006.01)
(Continued)

(52) U.S. Cl.
CPC ..... *B41J 3/4078* (2013.01); *B41J 11/002* (2013.01); *D06B 19/0076* (2013.01); *D06P 5/004* (2013.01)

(58) Field of Classification Search
CPC ... B41J 3/4078; B41J 11/002; D06B 19/0076; D06B 23/30; D06P 5/004; B41F 16/02; D06C 15/06
See application file for complete search history.

(56) References Cited

U.S. PATENT DOCUMENTS 4,118,179 A 10/1978 Ballinger
4,195,499 A * 4/1980 Yost ..... B41F 16/00 101/470
(Continued)

FOREIGN PATENT DOCUMENTS

CN 201176018 1/2009
CN 202174803 3/2012
(Continued)

OTHER PUBLICATIONS

International Preliminary Report on Patentability dated Jul. 11, 2019 From the International Bureau of WIPO Re. Application No. PCT/IL2017/051401. (6 Pages).
(Continued)

*Primary Examiner* — Bradley W Thies

(57) ABSTRACT

A fixation/transfer device for control of dye waste in a dye sublimation process. The device comprises a textile inlet, a textile outlet, a heat press or calender, an endless belt for driving the textile from the textile inlet to the textile outlet through the heat press, the heat press being held at a temperature sufficient to cause sublimation of the printing dye, and a cleaning station for cleaning the endless belt, the cleaning station being located downstream of the textile outlet and upstream of the textile outlet. The feed belt may be heated at the cleaning station so that sublimation may assist cleaning.

21 Claims, 6 Drawing Sheets

(51) Int. Cl.
*D06B 19/00* (2006.01)
*D06P 5/28* (2006.01)

(56) References Cited

U.S. PATENT DOCUMENTS

| | | | | |
|---|---|---|---|---|
| 9,156,248 | B1 * | 10/2015 | Thayer | B41F 35/02 |
| 2002/0027587 | A1 * | 3/2002 | Sugaya | B41M 7/00 347/104 |
| 2005/0139096 | A1 * | 6/2005 | Lu | B41J 3/4078 101/33 |

FOREIGN PATENT DOCUMENTS

| | | | | |
|---|---|---|---|---|
| CN | 204749482 | | 11/2015 | |
| CN | 204870055 | | 12/2015 | |
| GB | 2529333 | | 2/2016 | |
| GB | 2529333 | A * | 2/2016 | B41F 16/0093 |
| JP | 53-122884 | | 10/1978 | |
| JP | 54-060008 | | 5/1979 | |
| JP | 2015-108206 | | 6/2015 | |
| WO | WO 2018/122854 | | 7/2018 | |

OTHER PUBLICATIONS

International Search Report and the Written Opinion dated Apr. 12, 2018 From the International Searching Authority Re. Application No. PCT/IL2017/051401. (9 Pages).

Notification of Office Action and Search Report dated Jul. 21, 2020 From the State Intellectual Property Office of the People's Republic of China Re. Application No. 201780081237.9. (7 Pages).

Supplementary Partial European Search Report and the European Provisional Opinion dated Jul. 21, 2020 From the European Patent Office Re. Application No. 17885848.6. (13 Pages).

Supplementary European Search Report and the European Search Opinion dated Oct. 21, 2020 From the European Patent Office Re. Application No. 17885848.6. (13 Pages).

Translation dated Aug. 19, 2020 of Notification of Office Action dated Jul. 21, 2020 From the State Intellectual Property Office of the People's Republic of China Re. Application No. 201780081237.9. (6 Pages).

Notification of Office Action and Search Report dated Mar. 10, 2021 From the State Intellectual Property Office of the People's Republic of China Re. Application No. 201780081237.9 and Its Translation Into English. (13 Pages).

* cited by examiner

DYE SUBLIMATION CALENDER

RELATED APPLICATIONS

This application is a National Phase of PCT Patent Application No. PCT/IL2017/051401 having International filing date of Dec. 28, 2017, which claims the benefit of priority under 35 USC § 119(e) of U.S. Provisional Patent Application No. 62/439,506 filed on Dec. 28, 2016. The contents of the above applications are all incorporated by reference as if fully set forth herein in their entirety.

FIELD AND BACKGROUND OF THE INVENTION

The present invention, in some embodiments thereof, relates to a heat press or calender for use with a textile printer which uses dye sublimation.

Digital printing has replaced traditional methods in different branches of the graphics industry. There are multiple reasons for this shift but the main drivers are the cost-efficiency, possibility to personalise prints and flexibility.

The textile printing business is part of the graphics industry and the same trends apply. Traditional screen-printing is being replaced by digital textile printing solutions using ink jet and sublimation printing for shorter production runs and prints that require multiple colours and photographic imagery. The digital alternatives are ideal for the personalisation of prints, which is extremely popular nowadays.

Sublimation printing is a technique that uses heat sensitive inks. These inks turn into gas under the influence of heat and combine with various textile media such as a 100% polyester medium. The ink may actually become part of the structure of the material so that the images on the fabric do not fade or crack even after multiple washing. The ink may be transferred to the textile using transfer paper or a blanket. US 20080229962 A1 to Shedd et al relates to an example of sublimation transfer paper.

Calendering is used as a finishing process on textiles, typically to smooth, coat or thin a material, and to cause sublimation to occur when sublimation inks are in use. The fabric is passed through rollers, or between rollers and a drum, at high temperature and pressure with the inks being applied. The elevated temperature causes rapid sublimation, leading to a cloud of ink vapor. The vapor can get back to the textile, blurring the image or can cause breathing problems for the operator.

The excess ink, that wasn't absorbed by the fabric, needs to be absorbed to avoid smudging the image. The textile is thus placed on a moving belt and paper ("protective/kraft paper") is generally placed between the textile and the belt to absorb the ink. The paper mops up excess ink and is disposed of, and new paper is used for the next cycle. Thus the next cycle begins with a clean system. If the excess ink is somehow still present during the continuation, then ghosting of the new image may occur so it is important to do each image with fresh paper. In one implementation, in which a mirror image of the print to be made on the fabric is provided on transfer paper. The transfer paper is placed on the fabric and moved to the heat press or calender to carry out the sublimation process to transfer the image from the paper to the fabric. In such a case the transfer side of the fabric is in any event protected from the dye to be disposed on the calender as a new transfer is used. Hence there is no issue of ghosting on the new image or part of the fabric. The other side of the fabric, away from the transfer paper, however, does need to be protected from the effects of absorbed ink and this is achieved using another protective paper in order to prevent dye that penetrates the fabric from getting onto and contaminating the calender.

A second implementation, direct printing—in which the ink is printed directly onto the fabric requires protecting of the calender from both sides of the fabric with protective paper.

A belt calender is disclosed in U.S. Pat. No. 7,000,536 to Markus Laitila et al, filed May 3, 2001.

Thus in the current art, protective paper, or tissue paper, is used for excess dye absorption in a calender or heat press to protect the drum/platen and/or the blanket from the excess ink, and to protect the image from smudging. The paper, typically positioned between the fabric and the drum, absorbs excess dye that does not penetrate into the fabric.

The protective paper is a consumable and a waste product of the sublimation calender or heat press process. Suitable protective paper is often provided by the manufacturer of the calender.

The constant need to replace paper is wasteful. The paper does not do anything to control the cloud of particles due to sublimation.

SUMMARY OF THE INVENTION

The present embodiments may provide for an endless feed belt that can be cleaned directly, or for a drum that is cleaned directly. Hence the protective paper is not needed.

In the present embodiments the drum or platen may be protected by a moving belt, typically the feed belt, or there may be a feed belt and a pressure belt. The feed belt is an endless belt, and any of the belt, or both belts, or the belt and drum, may be cleaned as they turn. The feed belt, and for that matter the pressure belt, may perform the function of absorbing excess dye from the fabric and may be cleaned before being involved in forming the next image According to an aspect of some embodiments of the present invention there is provided a calender for fixation/transfer of dye sublimation, comprising:

a textile inlet;

a textile outlet;

a heat press or heated drum;

an endless belt for driving the textile from the textile inlet to the textile outlet through the heat press, the heat press being held at a temperature sufficient to cause sublimation of the at least one dye; and a cleaning station for cleaning the endless belt, the cleaning station being located downstream of the textile outlet and upstream of the textile outlet.

In an embodiment, the textile is in physical contact with the belt and the cleaning station is configured to clean dye residue from the belt.

In an embodiment, the cleaning station comprises a squeegee that cleans by wiping over a surface of the belt.

In an embodiment, the cleaning station comprises an applicator for applying a cleaning fluid to the belt.

In an embodiment, the belt comprises a smooth non-absorbing surface.

In an embodiment, the belt comprises an absorbing material.

An embodiment may comprise a heating unit at the cleaning station to cause sublimation of ink residue on the endless belt to aid with cleaning.

An embodiment may comprise a drum, a drum cleaning station for cleaning a surface of the drum, the cleaning unit being located downstream of the outlet point and upstream of the inlet point.

An embodiment may comprise a linear platen having a length, the platen being independently heatable at different locations to form a temperature profile along the length.

An embodiment may comprise a second endless belt and a second endless belt cleaning station, the second endless belt cleaning station being located downstream of the outlet point and upstream of the inlet point.

According to a second aspect of the present invention there is provided a calender for fixation/transfer of dye sublimation, comprising:

a textile inlet;

a textile outlet;

a heat press;

an endless belt for driving textile from the textile inlet to the textile outlet through the ink applicator and the heat press, the heat press configured to apply pressure to textile on the belt, the heat press further being heated to a temperature sufficient to cause sublimation of the dye, a vacuum source to clear vapor resulting from the dye sublimation.

In an embodiment, the textile is in contact with the belt during application of the at least one dye and a cleaning station is located downstream of the textile inlet and upstream of the textile outlet to clean dye residue from the belt.

According to a third aspect of the present invention there is provided a method of using a calender and dye sublimation, comprising:

inserting a textile into contact with an endless belt;

using the belt to drive the textile against a heat press;

maintaining the heat press at a temperature sufficient to induce sublimation of at least one temperature sensitive dye on the textile;

removing the textile; and cleaning the endless belt.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
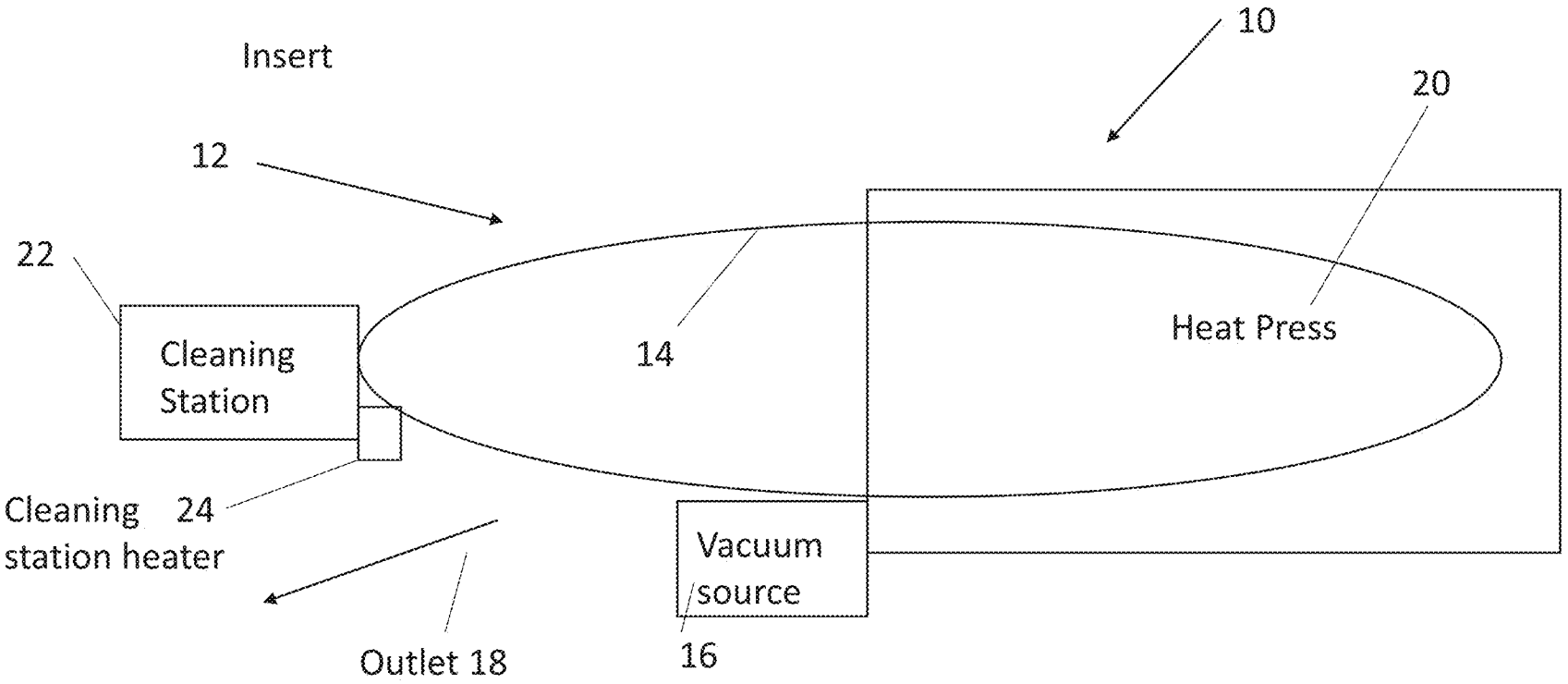
FIG. 1 is a simplified block diagram illustrating a generalized embodiment of the present invention.

The present invention, in some embodiments thereof, relates to a heat press or calender which is used for dye sublimation transfer/fixation.

In calender printing on textiles and fabrics, including on garments, the fabric with inks applied, is passed through rollers or a drum at high temperature and pressure is applied. Typically the inks are sublimation inks and the elevated temperature causes rapid sublimation, leading to a cloud of ink vapor which may be problematic and thus should be kept under some level of control. In addition, excess ink, which is not absorbed by the fabric, needs to be absorbed somewhere so that the image is not spoiled, and which needs to be removed before the next image is processed so as to avoid ghosting.

The present embodiments provide a feed belt that keeps excess ink, including ink vapor, under control. The belt may carry out the task of absorbing the excess inks from the process. Absorption is helped if the belt has a porous consistency, and desublimation occurs if the belt is held at or reaches a low enough temperature, that is to say the belt is at a temperature that is below the sublimation temperature by a margin sufficient to cause significant levels of desublimation, typically not exceeding 100 to 120 degrees Celsius, and the belt may reach these temperatures outside of the calender. The belt may be cleaned between rotations, for example at a cleaning station. The cleaning station may wipe the belt surface, and/or use cleaning fluids, and/or use of heating unit or combine both wiping and use of cleaning fluids and heating.

Control of the vapor cloud may be carried out by vacuuming. In the case of a porous belt vacuuming may be carried from behind the belt within the calender. In the case of a smooth belt, the belt itself confines the vapor and vacuuming can be applied at the exit of the calender.

A linear version of the calender allows for a temperature profile to be set up along the fixation/transfer machine.

The term "calender" refers herein to a drum and rollers that press the textile under heat, and "calendering" refers to the activity of pressing within a calender.

A calender is a form of heat press, and the present embodiments extend to the use of heat presses in general to bring about sublimation of the inks.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a simplified diagram that illustrates a generalized schematic of a calender according to the present embodiments. The machine 10 is intended for sublimation process of textiles, whether in cloth, say as rolls, or cut, as in garment form, using dye sublimation of heat sensitive inks or dyes. The machine 10 comprises an insert point 12 where textile is inserted into the device, and more particularly onto an endless feed belt 14. Printing may have been carried out using deposition of the ink by inkjet or screen printing or other methods or may include insertion of transfer paper which is already printed for transfer to the textile. It is noted that the terms "ink" and "dye" are used interchangeably herein.

The endless belt drives the textile from the textile insert point 12 through heat press 20, to eventually arrive at textile outlet 18. The heat press may apply heightened temperature and pressure levels to the textile, and is held at a temperature sufficient to cause sublimation of the dye or dyes, which is typically in the range of 180 to 220 degrees Celsius, depending on the type of dye. The heat press may typically but not necessarily be a calender. In the case of transfer the transfer paper enters the calender with the textile and transfer of the image may occur within the calender.

The image is fixed on the textile in the heat press and then the textile is removed from the calender at outlet 18. The endless belt continues on towards insert point 12, on the way passing cleaning station 22. The cleaning station is located as shown, downstream of the outlet and upstream of the insert point and cleans the endless belt before next use. As the textile was in physical contact with the belt whilst in the heat press, ink residue may reside on the belt and is removed at the cleaning station.

The cleaning station may physically clean the belt. For example the cleaning station may use a squeegee that operates by wiping over a surface of the belt. Cleaning may be carried out dry.

The cleaning station 22 may alternatively or additionally use wet cleaning. Cleaning fluid may be applied directly to the belt, say from an applicator. The cleaning fluid may be water or any other suitable solvent and may contain added detergent and/or IPA (isopropyl acetate) and/or Acetone In addition, a combination of the above may be used, in which the squeegee serves to wipe the cleaning fluid over the surface of the belt.

The belt itself may in one embodiment comprise a smooth non-absorbing surface, say Teflon™. Such a non-absorbing surface is particularly suitable for physical cleaning.

Alternatively the belt may comprise an absorbing material, for example a material with a porous or spongy consistency. Such a material is suitable for wet cleaning. Examples of such material include polyurethane.

In embodiments, the feed belt may be of a porous material and other surfaces that need cleaning may be of a smooth material.

In the case of a porous belt, a vacuum may be applied across the belt to clear away the cloud. In the case of a smooth belt, the belt itself may confine the vapor cloud and vacuum need only be applied at vacuum source 16 at the exit of the heat press.

The cleaning station may include a cleaning station heating unit 24 to heat the belt during cleaning. The result is further sublimation of the ink particles, this time to clean the belt.

Figure 2:
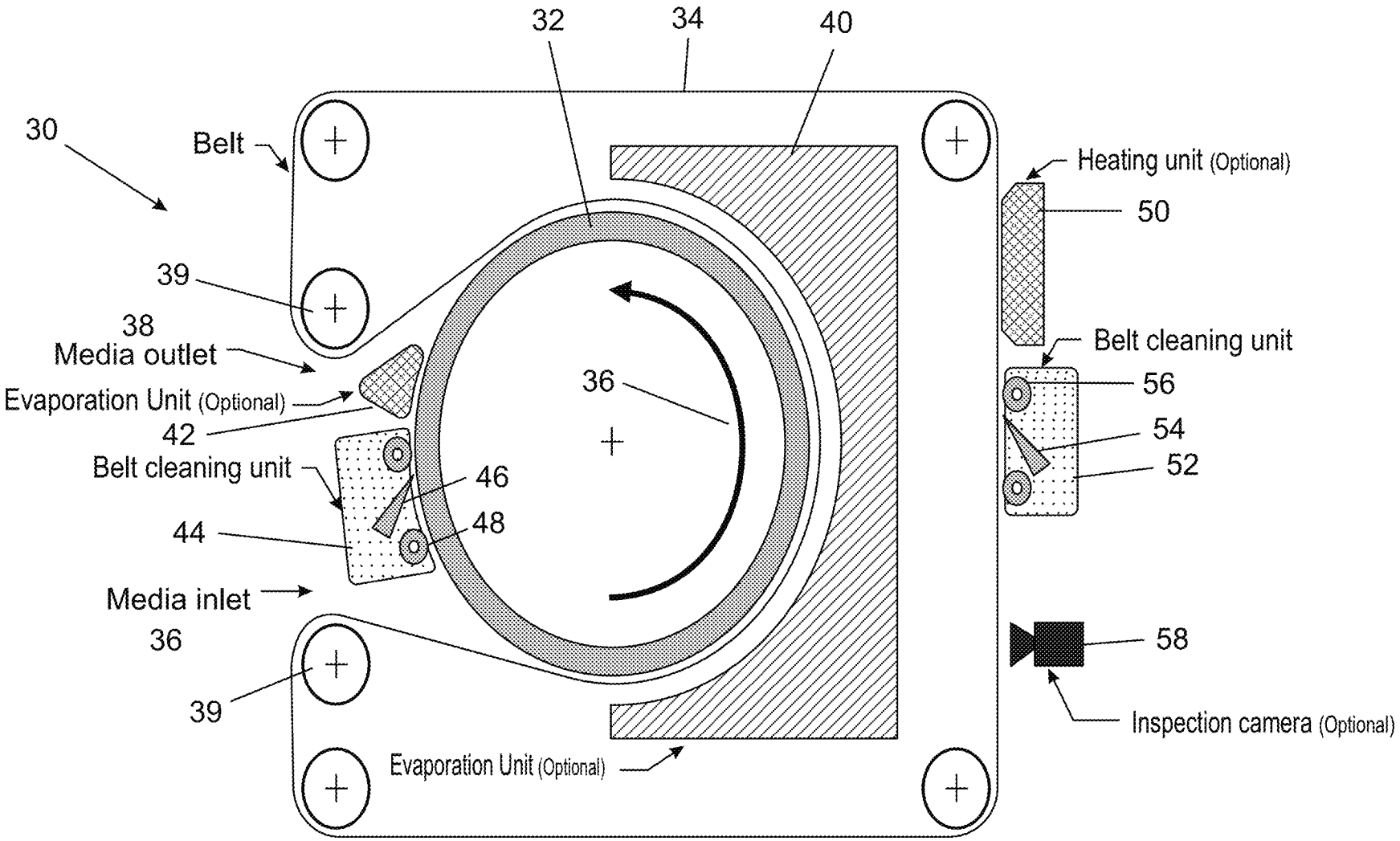
FIG. 2 is a simplified schematic diagram showing an embodiment of the present invention with a drum and a single belt.

As discussed, the heat press may be a calender. As will be discussed in greater detail below, the calender may be formed by a drum and rollers as shown in FIG. 2, or by two belts, a drum and rollers as in FIG. 3 or by a platen, rollers and belts as shown in FIG. 4.

Figure 5:
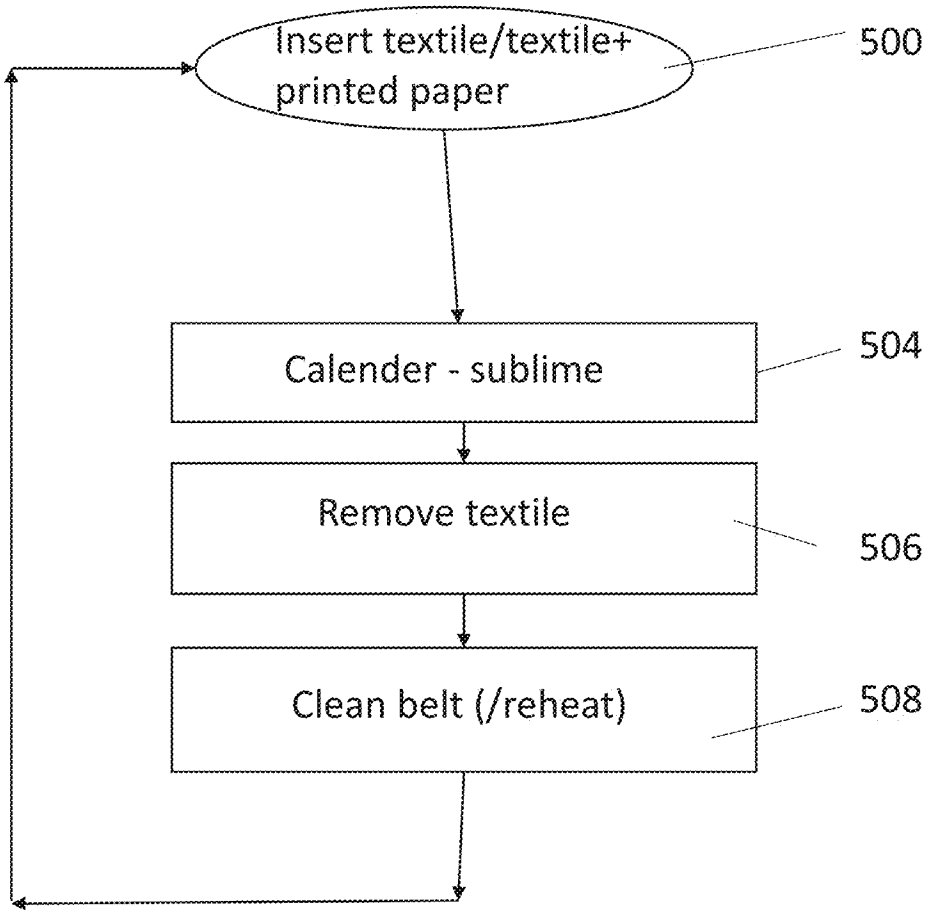
FIG. 5 is a simplified flow chart showing a method of using subliming inks and cleaning the feed belt and optionally the pressure belt and drum, according to an embodiment of the present invention.

Reference is now made to FIG. 5, which is a simplified flow chart showing use of the sublimation machine using a calender or heat press and dye sublimation. The method comprises inserting a printed textile or a transfer paper and a textile onto a feed belt at an input location—box 500 so that the textile is in physical contact with the belt. As shown in box 504 the calender heats the dye to a sufficient temperature and causes sublimation, as the textile is pressed by the belt against the calender. The textile is removed as shown in box 506 and then the belt is cleaned, box 508.

Figure 6:
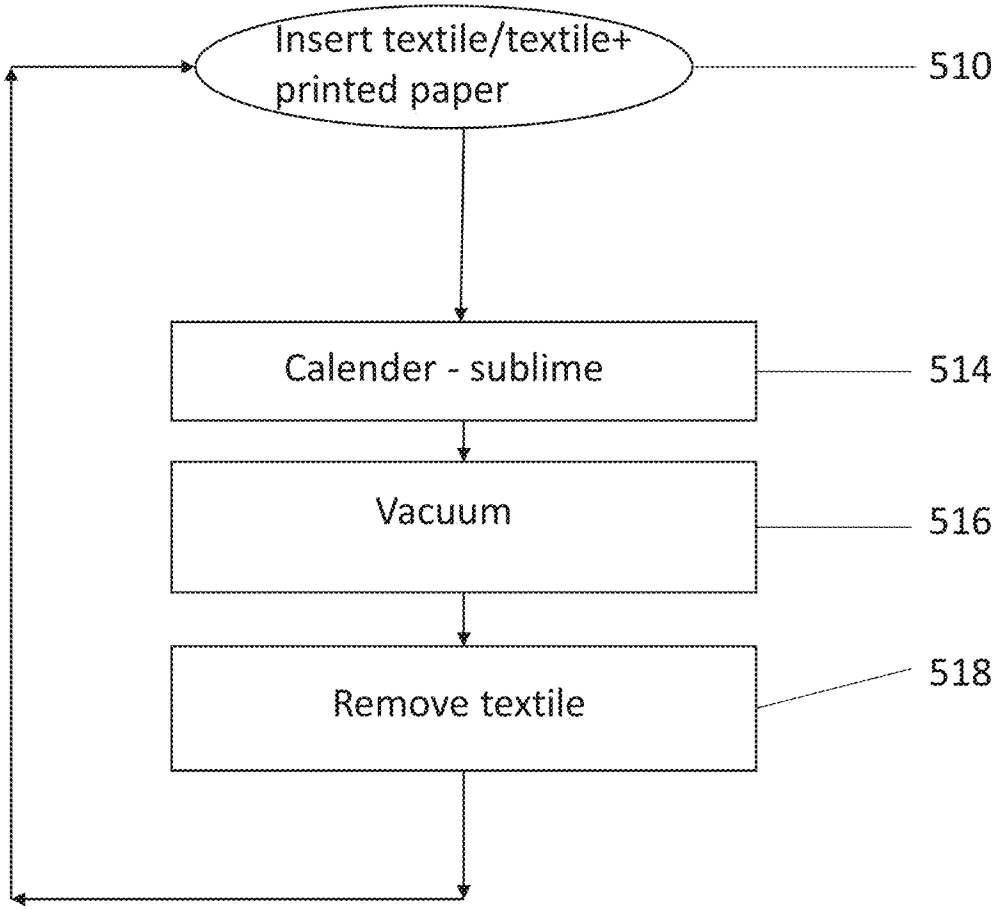
FIG. 6 is a simplified diagram showing a method of using subliming inks and pumping the excess dye by vacuum through the belt.

Reference is now made to FIG. 6, which is a simplified flow chart illustrating use of an alternative embodiment of the present invention. Again, the flow chart shows use of the sublimation machine using a calender or heat press and dye sublimation. The method comprises inserting a printed textile or a transfer paper and a textile onto a feed belt at an input location—box 510 so that the textile is in physical contact with the belt. As shown in box 514 the calender heats the dye to a sufficient temperature and causes sublimation, as the textile is pressed by the belt against the calender. In box 516 the region is then vacuumed to remove the vapor from the ink sublimation. In the case of a porous belt, vacuuming can be carried out in the calender through the belt. In the case of a smooth belt, the belt itself may confine the vapor within the calender, and vacuuming may be carried out at the exit of the calender. The textile is then removed as shown in box 518. Typically the belt is cleaned as in the previous flow chart and box 508.

Returning now to FIG. 2 and a cross section is shown of a calender device 30 having a drum 32 and an endless feed belt 34. The drum rotates anti-clockwise as indicated by arrow 36. The belt rotates in the same direction around the drum and in the opposite direction around the periphery of the calender device. Textiles are inserted at media insertion point 36 and are driven around the drum 32 by belt 34 and delivered at media outlet 38. The textile is located between the drum 32 and belt 34. The drum 32 is part of a calender together with rollers 39, and the heats and presses the textile, causing sublimation of the ink and causing excess ink to be absorbed into the fabric. Some of the ink that is in vapor phase may collect either on the drum or on the belt and is the reason why cleaning is required. Optional main evaporation unit 40 clears vapors.

Following removal of the textile at outlet 38, the drum rolls on to drum cleaning evaporation unit 42 and cleaning unit 44. The evaporation unit clears vapor and then the cleaning unit uses squeegee 46 and/or cleaning fluid applicators 48, to clean the surface of the drum and thus prevent the ink residues from causing ghosting on subsequent images.

A similar cleaning mechanism is provided for the belt 34. Following removal of the textile at outlet 38, the belt feeds on to evaporation unit 50 and cleaning unit 52. The evaporation unit may help to encourage sublimation of the residues, and then the cleaning unit uses squeegee 54 and/or cleaning fluid applicators 56, to clean the surface of the belt and thus prevent the ink residues from causing ghosting on subsequent images.

An inspection camera 58 may optionally be provided in order to identify any residue remaining on the belt.

Figure 3:
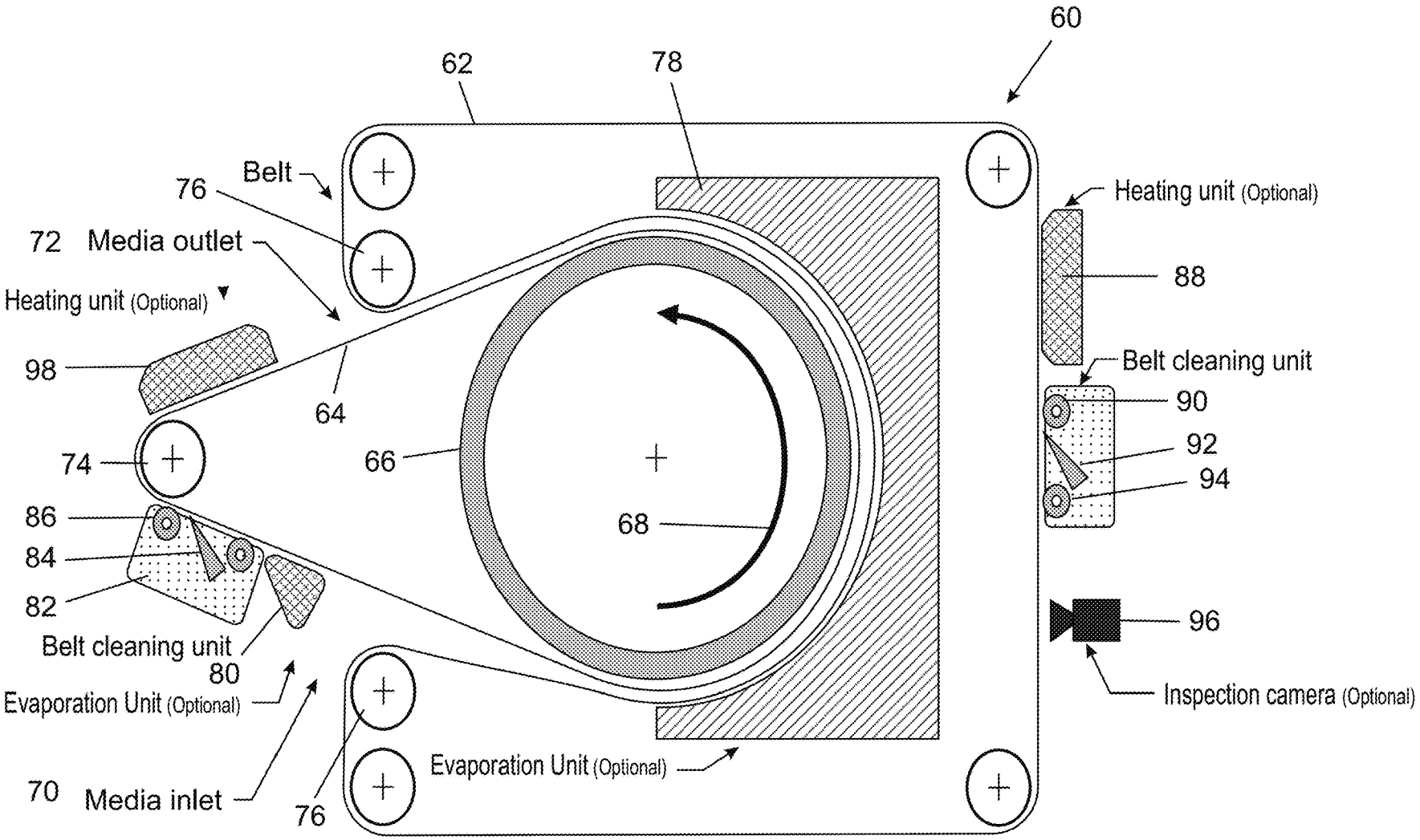
FIG. 3 is a simplified schematic diagram showing an embodiment of the present invention with a drum, a pressure belt and a feed belt.
Figure 4:
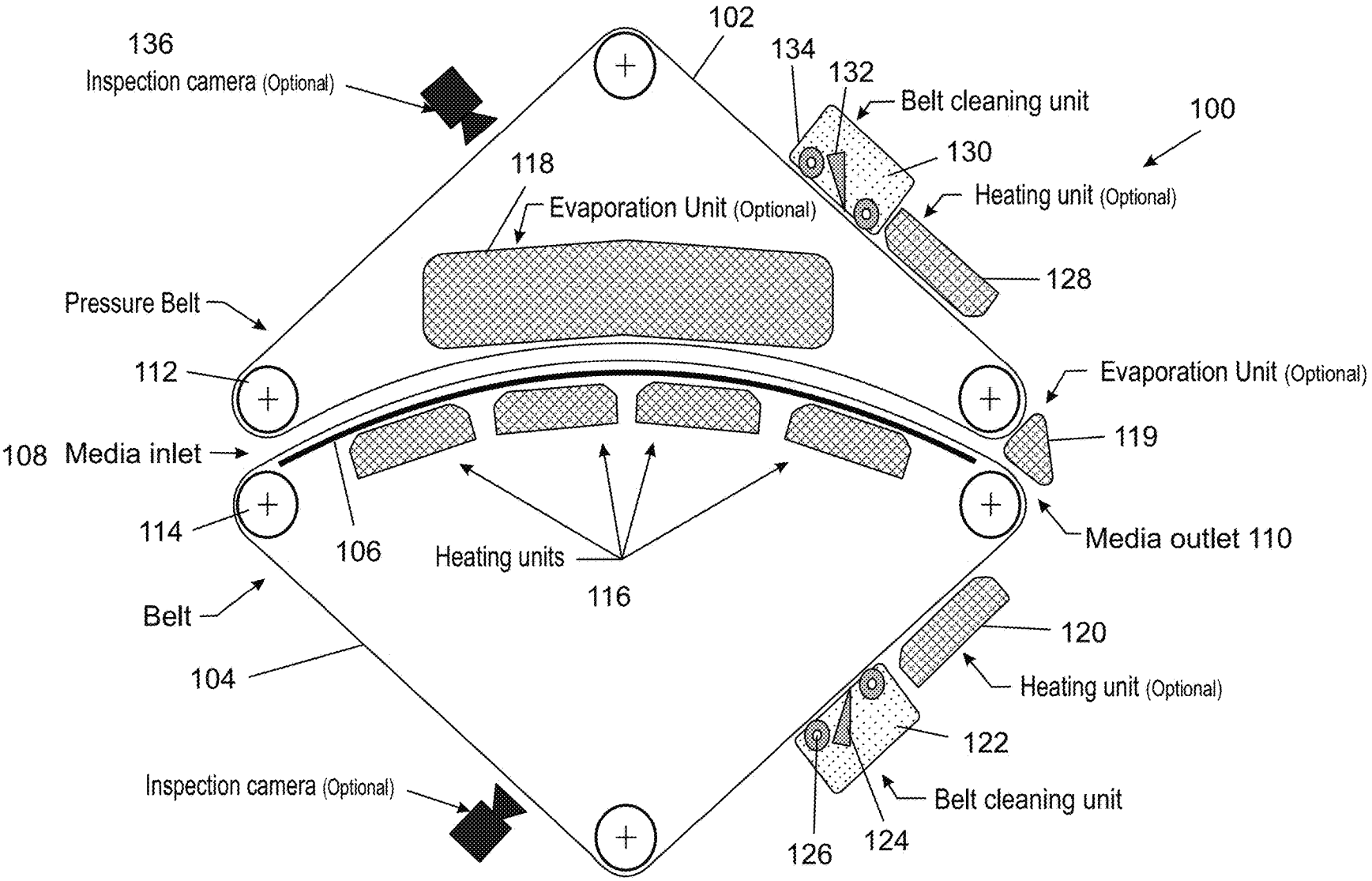
FIG. 4 is a simplified schematic diagram showing an embodiment of the present invention using a feed belt, a pressure belt and a platen.

Reference is now made to FIG. 3, which is an alternative calender device 60 according to an embodiment of the present invention in which the textile is located between two belts, outer belt 62 and inner belt 64. Thus the textile is in physical contact with the belts and not directly with the drum 66.

The drum rotates anti-clockwise as indicated by arrow 68. The outer belt 62 rotates in the same direction around the drum and in the opposite direction around the periphery of the calender device. The inner belt 64 rotates in the same direction as the drum. Textiles are inserted at media inlet 70 and are driven around the drum 66 by inner and outer belts 62 and 64 and delivered at media outlet 72. The textile is located between the inner and outer belts and thus does not touch the drum. The drum 66 is part of a calender together with rollers 74 and 76, and the calender heats and presses the textile, causing sublimation of the ink and causing excess ink to collect, either on the inner or outer belt. Main evaporation unit 78 causes ink to sublime.

Following removal of the textile at outlet 72, the inner belt feeds on to inner belt cleaning evaporation unit 80 and cleaning unit 82. The evaporation unit clears fumes from the inner belt and then the cleaning unit uses squeegee 84 and/or cleaning fluid applicators 86, to clean the surface of the inner belt and thus prevent the ink residues from causing ghosting on subsequent images.

A similar cleaning mechanism is provided for the outer belt 62. Following removal of the textile at outlet 38, the belt feeds on to outer belt cleaning heating unit 88 and cleaning unit 90. The heating unit heats the belt to cause sublimation of the residues and then the cleaning unit uses squeegee 92 and/or cleaning fluid applicators 94, to clean the surface of the belt and thus prevent the ink residues from causing ghosting on subsequent images.

Optional camera 96 may observe areas of residue on outer belt 62 which have not been cleaned.

Optional heating unit 98 may heat the inner belt 64 prior to use.

Reference is now made to FIG. 4, which is an alternative calender device 100 according to an embodiment of the present invention in which the textile is located between two belts, upper belt 102, which is a pressure belt, and lower belt 104, which is the feed belt. The embodiment may use a platen 106 instead of a drum for calendering. Thus the textile is in physical contact with the belts and the inlet and outlet points are at opposite sides of the calender. Both belts are cleaned.

The platen 106 remains fixed as both belts pass over in the direction from media inlet 108 to outlet 110 carrying the textile. Textiles are inserted at media inlet 108 and are driven over the platen 106 by the upper and lower belts 102 and 104 and delivered at media outlet 110. The textile is located between the upper and lower belts and thus does not touch the platen 106. The platen is part of a calender together with rollers 112 and 114 which press the belts against the platen to provide pressure. Heating units 116 heat the platen 106, and the heat and pressure causes ink residue to gather on the belts and sublimation of the ink. Optional evaporation unit 118 may suck vapor through the belt.

An outlet evaporation unit 119 may further help to clear fumes. Following removal of the textile at outlet 110, the lower belt rolls on to lower belt cleaning heating unit 120 and cleaning unit 122. The heating unit 120 heats the lower belt to cause sublimation of the residues and then the cleaning unit 122 uses squeegee 124 and/or cleaning fluid applicators 126, to clean the surface of the lower belt and thus prevent the ink residues from causing ghosting on subsequent images.

A similar cleaning mechanism is provided for the upper belt 102. Following removal of the textile at outlet 110, the upper belt feeds on to upper belt cleaning heating unit 128 and cleaning unit 130. The heating unit 128 heats the upper belt to cause sublimation of the residues and then the cleaning unit 130 uses squeegee 132 and/or cleaning fluid applicators 134, to clean the surface of the belt and thus prevent the ink residues from causing ghosting on subsequent images.

Optional camera 136 may observe areas of residue on lower belt 104 which have not been cleaned.

The embodiment of FIG. 4 uses a platen instead of a drum. A pressure belt provides pressure to the textile by pressing the textile and first belt to the platen. The embodiment allows for a series of heaters in a linear arrangement to provide a controllable temperature profile rather than a single temperature. The separate heaters allow for the platen to be independently heatable at different locations to form a temperature profile along its length.

With such a temperature profile, the high temperature needed for subliming need be applied only at a defined part of the travel, and different temperatures may be provided at other parts of the travel to achieve different purposes. In particular, materials that are particularly sensitive to temperature can be kept at the high temperature needed for subliming only for the minimum time necessary, and there is more control over the length and timing of the process.

Aside from the temperature profile, the arrangement has an advantage for material control. The textile material enters at one side and exists at the opposite side, rather than returning to the same side as with the drum machines.

It is expected that during the life of a patent maturing from this application many relevant heat press and calender devices will be developed, as well as different kinds of sublimation inks and dye and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention, and the present specification is to be construed as if all such combinations are written out explicitly. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A calender apparatus for fixation/transfer of images on textile, the fixation/transfer being by dye sublimation, the dye being suitable for use with textiles, the apparatus comprising:

a dyed textile inlet for input of a textile, the textile carrying an image, the image being prior to fixing and comprising said dye suitable for use with textiles;

a textile outlet for output of said textile;

a heat press comprising a calender, the calender comprising a heated rotary textile-pressing drum;

an endless belt configured to drive said textile from said textile inlet to said textile outlet through said heat press, said heat press being held at a temperature sufficient to cause sublimation of said dye suitable for use with textiles, thereby to fix said image onto said textile, the heated rotary textile-pressing drum being configured to rotate with said textile; and a cleaning station configured to clean said endless belt to remove traces of said dye suitable for textiles, said cleaning station being located downstream of said textile outlet and upstream of said textile inlet such that a path of said textile from said textile inlet to said textile outlet does not pass said cleaning station.

2. The calender apparatus of claim 1, wherein said textile is in physical contact with said belt and said cleaning station is configured to clean dye residue from said belt.

3. The calender apparatus of claim 1, wherein said cleaning station comprises a squeegee that cleans by wiping over a surface of said belt.

4. The calender apparatus of claim 1, wherein said cleaning station comprises an applicator for applying a cleaning fluid to said belt.

5. The calender apparatus of claim 1, wherein said belt comprises a smooth non-absorbing surface.

6. The calender apparatus of claim 1, wherein said belt comprises an absorbing material.

7. The calender apparatus of claim 1, comprising a heating unit at said cleaning station to cause sublimation of ink residue on said endless belt to aid with cleaning.

8. The calender apparatus of claim 1, comprising a drum cleaning station for cleaning a surface of said drum, said cleaning unit being located downstream of said outlet point and upstream of said inlet point.

9. The calender apparatus of claim 8, further comprising a second endless belt and a second endless belt cleaning station, said second endless belt cleaning station being located downstream of said outlet point and upstream of said inlet point.

10. The calender apparatus of claim 1, comprising a linear platen having a length, the platen being independently heatable at different locations to form a temperature profile along said length.

11. A calender apparatus for fixation/transfer of dye sublimation, the dye being suitable for textiles, comprising:

a textile inlet for input of a textile, the textile imprinted with a wet image formed using the dye suitable for textiles;

a textile outlet for output of said textile;

a heat press;

an endless belt configured for driving a textile from said textile inlet to said textile outlet through said ink applicator and said heat press, said heat press comprising a calender, said calender comprising a rotating textile-pressing heat drum, the heat press configured to apply pressure to said textile on said endless belt, said heat press further being heated to a temperature sufficient to cause sublimation of said dye suitable for textiles, thereby to fix said image into said textile; and a vacuum source located with said heat press to clear vapour resulting from said dye sublimation.

12. The calender apparatus of claim 11, wherein said textile is in contact with said belt during application of said at least one dye and a cleaning station is located downstream of said textile inlet and upstream of said textile outlet to clean dye residue from said belt.

13. The calender apparatus of claim 11, wherein said cleaning station comprises a squeegee that cleans by wiping over a surface of said belt.

14. The calender apparatus of claim 11, wherein said cleaning station comprises a cleaning applicator for applying a cleaning fluid to said belt.

15. The calender apparatus of claim 11, wherein said endless belt comprises a smooth non-absorbing surface.

16. The calender apparatus of claim 11, wherein said endless belt comprises an absorbing material.

17. The calender apparatus of claim 11, comprising a heating unit at said cleaning station to cause sublimation of ink residue on said endless belt to aid with cleaning.

18. The calender apparatus of claim 11, wherein said heat press comprises a calender.

19. The calender apparatus of claim 18, wherein said calender comprises a drum.

20. The calender apparatus of claim 18, wherein said calender comprises a second endless belt.

21. A method of using a calender and dye sublimation, comprising:

placing an image onto a textile, the image in wet dye, the wet dye suitable for use with textiles;

inserting said textile into contact with an endless belt;

using said belt to drive said textile against a heat press, the heat press comprising a rotating textile-pressing heat drum;

maintaining said heat press at a temperature sufficient to induce sublimation of at least one temperature sensitive dye on said textile, thereby to fix said image on said textile;

removing said textile; and cleaning said endless belt.

* * * * *